US005156388A

United States Patent [19]

Morita

[11] Patent Number: 5,156,388

[45] Date of Patent: Oct. 20, 1992

[54] PAPER SUPPLYING DEVICE HAVING REMOVABLE PAPER SUPPLYING ROLLERS

[75] Inventor: Takakazu Morita, Osaka, Japan

[73] Assignee: Mita Industrial Co., Ltd., Osaka, Japan

[21] Appl. No.: 768,020

[22] Filed: Sep. 30, 1991

[30] Foreign Application Priority Data

Oct. 16, 1990 [JP] Japan ..... 2-277033

[51] Int. Cl.[5] ..... B65H 3/06

[52] U.S. Cl. ..... 271/109; 271/117; 271/164

[58] Field of Search ..... 271/109, 117, 162, 164

[56] References Cited

U.S. PATENT DOCUMENTS

| | | | |
|---|---|---|---|
| 4,351,519 | 9/1982 | Jendrick | 271/117 |
| 4,664,252 | 5/1987 | Galbraith | 271/109 |
| 4,728,094 | 3/1988 | Yoshida | 271/164 |
| 5,004,223 | 4/1991 | Okui | 271/275 |
| 5,040,779 | 8/1991 | Ogiri et al. | 271/109 |

FOREIGN PATENT DOCUMENTS

| | | | |
|---|---|---|---|
| 6552 | 1/1979 | Japan | 271/164 |
| 125538 | 7/1983 | Japan | 271/109 |
| 86330 | 5/1986 | Japan | 271/109 |
| 178334 | 8/1986 | Japan | 271/109 |
| 203037 | 9/1986 | Japan | 271/109 |
| 294131 | 11/1989 | Japan | 271/109 |

*Primary Examiner*—Robert P. Olszewski
*Assistant Examiner*—Steven M. Reiss
*Attorney, Agent, or Firm*—Wenderoth, Lind & Ponack

[57] ABSTRACT

In a paper supplying device in an image forming apparatus, a circular groove is formed at one position of a roller shaft of a paper supplying roller. An engaging-connecting portion is releasably engaged in such circular groove and is formed in a member to be pressed by a paper supplying cassette. The member thus is connected to the paper supplying roller but is rotatable relative thereto.

15 Claims, 8 Drawing Sheets

PAPER SUPPLYING DEVICE HAVING REMOVABLE PAPER SUPPLYING ROLLERS

BACKGROUND OF THE INVENTION

The present invention relates to a paper supplying device used in an image forming apparatus such as an electrostatic copying machine or a printer, in particular to a paper supplying device in which a paper supplying cassette is adapted to be inserted into and extracted from a paper supplying portion in the direction of an axis of rotation of a paper supplying roller.

With such paper supplying device, a disadvantage occurs in that, for example, when the paper supplying cassette is charged in the direction of the axis of rotation of the paper supplying roller, papers housed in the paper supplying cassette in layers are engaged with an end face portion of the paper supplying roller, and thereby can become damaged or shifted sideways.

A paper supplying device having a construction shown in FIG. 13 has been employed by the present applicant (MITA INDUSTRIAL CO. LTD) as a paper supplying device capable of solving such disadvantage (Japanese Patent Application No. Hei 1-183476, U.S. patent application Ser. No. 07/552,691).

In such paper supplying device, a paper supplying roller 62 of a paper supplying portion 61 is provided so as to be removable in the direction of an axis of rotation, a paper supplying cassette 63 being provided so as to be inserted into and extracted from paper supplying portion 61 in the direction of the axis of rotation of paper supplying roller 62. Paper supplying cassette 63, when inserted into the paper supplying portion 61, is lifted by pressing means 67 composed of a cam roller 66 and a cam member 65 provided on the paper supplying cassette 63 and a guide member 64, respectively, to press an upper surface of papers (a) housed in layers in the paper supplying cassette 63 against the paper supplying roller 62.

In addition, a member to be pressed 68 receives a pressing force from the paper supplying cassette 63 before the upper surface of papers (a) is pressed against the paper supplying roller 62. Member 68 is mounted on a member 69 that is movable in a direction of movement of the paper supplying roller 62. Roller 62 is connected to movable member 69 so as to be rotatable relative thereto. Thus, member 68 may move in the cassette inserting direction integrally with the paper supplying roller 62 by member 68 being pressed by the paper supplying cassette 63 before the upper surface of the papers (a) is pressed against the paper supplying roller 62. The member 68 and the paper supplying roller 62 are returned to an initial position by means of returning means 71 connected between the movable member 69 and a fixed member. With such construction, the paper supplying roller 62 moves in the cassette inserting direction integrally with the paper supplying cassette 63 from a midway of the insertion of the paper supplying cassette 63 into the paper supplying portion 61, thus gradually lifting the paper supplying cassette 63 in an inclined manner by a guiding action of pressing means 67. Thus, the upper surface of the papers (a) within the paper supplying cassette 63 is pressed against the paper supplying roller 62. Accordingly, the papers can be prevented from being damaged and shifted sideways in spite of the fact that cassette 63 is possibly inserted and extracted in the direction of the axis of rotation of the paper supplying roller 62.

However, in the above described paper supplying device, the member 68 and a plate member 72 connected with the movable member 69 at opposite ends thereof in the cassette inserting direction are provided with respective notched engaging portions 74, with which a roller shaft 73 of the paper supplying roller 62 is engaged. Two circular grooves 75 are formed in roller shaft 73 at positions corresponding to outer side surfaces of respective notched engaging portions 74. Each respective circular groove 74 is provided with a seat 76 mounted therein. The member 68 being engaged with the respective seat 76 thereof on the downstream side thereof in the cassette inserting direction. Plate member 72 is engaged with the respective direction. Thereby, the member 68 is connected with the roller shaft 73. However, this construction has the disadvantage that assembly efficiency is not satisfactory. Furthermore, two circular grooves 75 must be formed in the roller shaft 73 such that manufacturing costs of the roller shaft 73 thereby are increased.

SUMMARY OF THE INVENTION

The present invention has been achieved in view of the above described circumstances, and it is an object of the present invention to provide a paper supplying device in an image forming apparatus whereby it is possible not only to easily connect a member to be pressed with a roller shaft, but also to easily manufacture the roller shaft.

The above described object is achieved by a paper supplying device in an image forming apparatus wherein a paper supplying cassette is adapted to be inserted into and extracted from a paper supplying portion in a direction of an axis of rotation of a paper supplying roller. The paper supplying roller is adapted to be movable in such direction. Pressing means presses an upper surface of papers within the paper supplying cassette against the paper supplying roller during movement of the paper supplying cassette into the paper supplying portion. A member to be pressed by a pressing force from the paper supplying cassette before the upper surface of the papers is pressed against the paper supplying roller is mounted on a member that is movable in a direction of movement of the paper supplying roller. Such movable member is connected with the paper supplying roller so as to be only rotatable relative thereto. Returning means returns the member to be pressed to an initial position.

A first aspect of the invention provides that a circular groove is formed at one position of a roller shaft of the paper supplying roller and an engaging-connecting portion engaging in such circular groove is formed in the member to be pressed so as to be disengageable therefrom. Thus, the paper supplying roller is connected with the movable member so as to be only rotatable relative thereto.

A second aspect of the invention provides that a circular groove is formed at one position of the roller shaft of the paper supplying roller and an engaging-connecting portion disengageably engaging the circular groove is formed in a plate member connected with the movable member.

According to the above described characteristic construction of both aspects of the present invention, the paper supplying roller can be connected with the movable member so as to be rotatable relative thereto by engaging in the circular groove formed in the roller shaft of the paper supplying roller the engaging-connecting portion.

DESCRIPTION OF THE PREFERRED EMBODIMENTS

Figure 1:
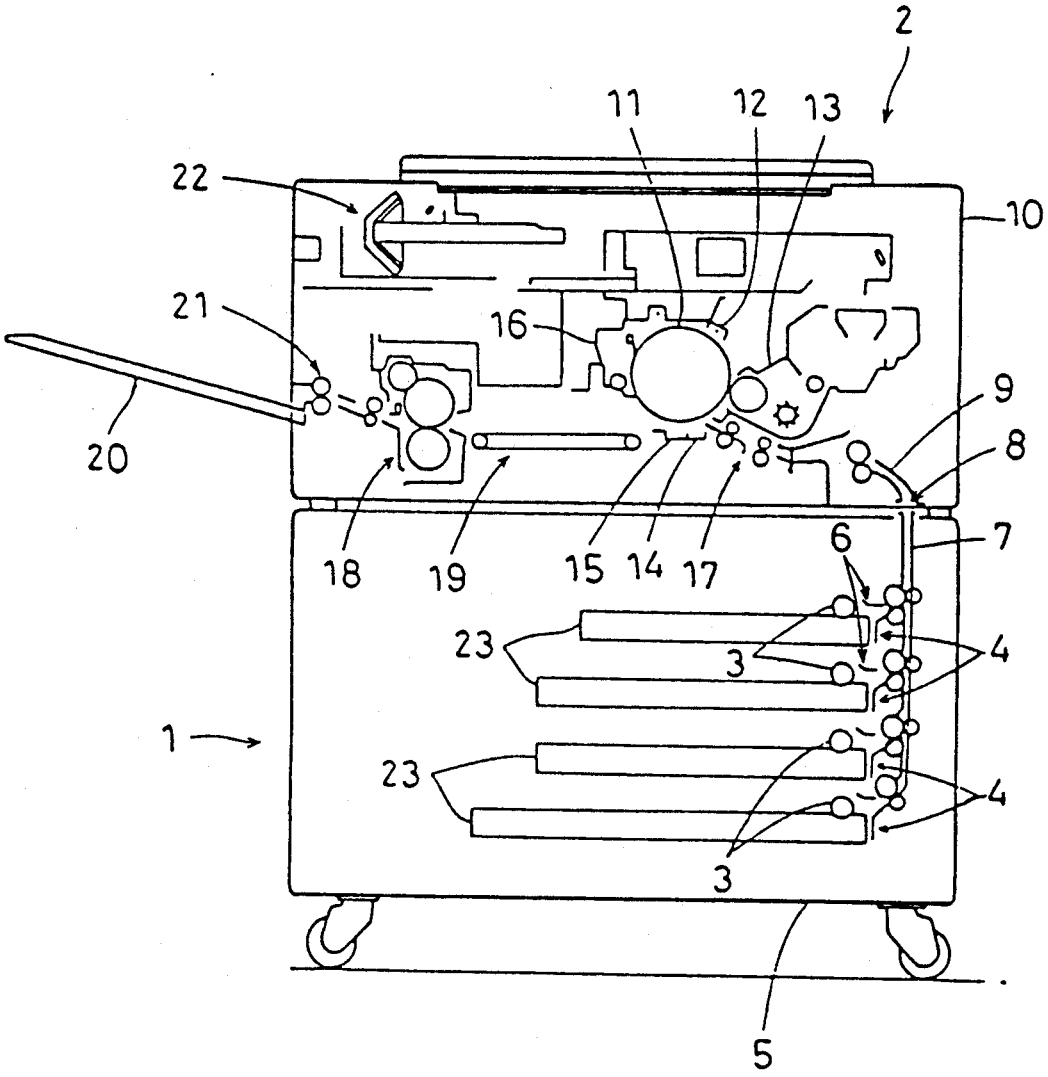
FIG. 1 is a schematic longitudinally sectioned side view showing an image forming apparatus.

Preferred embodiments of the present invention will be described below with reference to the drawings. FIG. 1 shows an electrostatic photographic copying machine as one example of an image forming apparatus and comprising a paper supplying unit 1 and an image forming apparatus body 2 carried on paper supplying unit 1.

The paper supplying unit 1 is provided therein with a plurality of vertically spaced stages of paper supplying portions 4 each having a paper supplying roller 3, respectively, a movable casing 5, paper supplying passages 6 leading from respective paper supplying portions 4, a paper supplying passage 7 into which pass paper supplying passages 6 and a paper discharging port 8 of paper supplying passage 7 opened in one side of an upper portion of said movable casing 5.

Image forming apparatus body 2 is provided with a paper discharging passage 9 connected with paper discharging port 8 of the paper supplying unit 1 at one side of a lower portion of a body casing 10 when body 2 is carried on the paper supplying unit 1. Body casing 10 is provided therein with a photoreceptor 11 extending thereover sideways.

A charging device 12, a developing device 13, a transfer device 14, a paper separating device 1 and a cleaning device 16 are arranged around photoreceptor 11. A paper supplying passage 17 extends from paper supplying passage 9 to transfer device 14. A paper supplying passage 19 supplies to a fixing device 18 a transferred and separated paper. A paper discharging roller 21 discharges a fixed paper to a paper discharging tray 20. An exposing device 22 of the movable optical system type is arranged in an upper space of the body casing 10.

As shown in FIGS. 2 to 6, a paper supplying cassette 23 is adapted to be inserted into and extracted from any of the plurality of vertically spaced stages of paper supplying portions 4 of the paper supplying unit 1 in a direction parallel to the axis of rotation of the respective paper supplying roller 3. Paper supplying cassette 23 is provided with a casing 23*a* having therein a carrying plate 24 which is swingable around an axis extending parallel to the direction in which the cassette is inserted (direction P of the axis of rotation of the paper supplying roller 3 and hereinafter referred to as a cassette introducing direction P). Paper end regulating plates 25 are provided at an upstream end relative to a paper supplying direction Q and at sides of carrying plate 24. Paper separating tabs or clicks 26 restrain opposite downstream corners relative to paper supplying direction Q (both corners in paper supplying direction Q meet at right angles with cassette introducing direction P) of papers (a) carried in a stack on the carrying plate 24. Energizing means 27 lifts carrying plate 24 toward paper separating clicks 26. Carrying plate 24 is provided with an opening (t) into which a no paper detecting sensor 28 falls when papers (a) remain on page 24.

Figure 8:
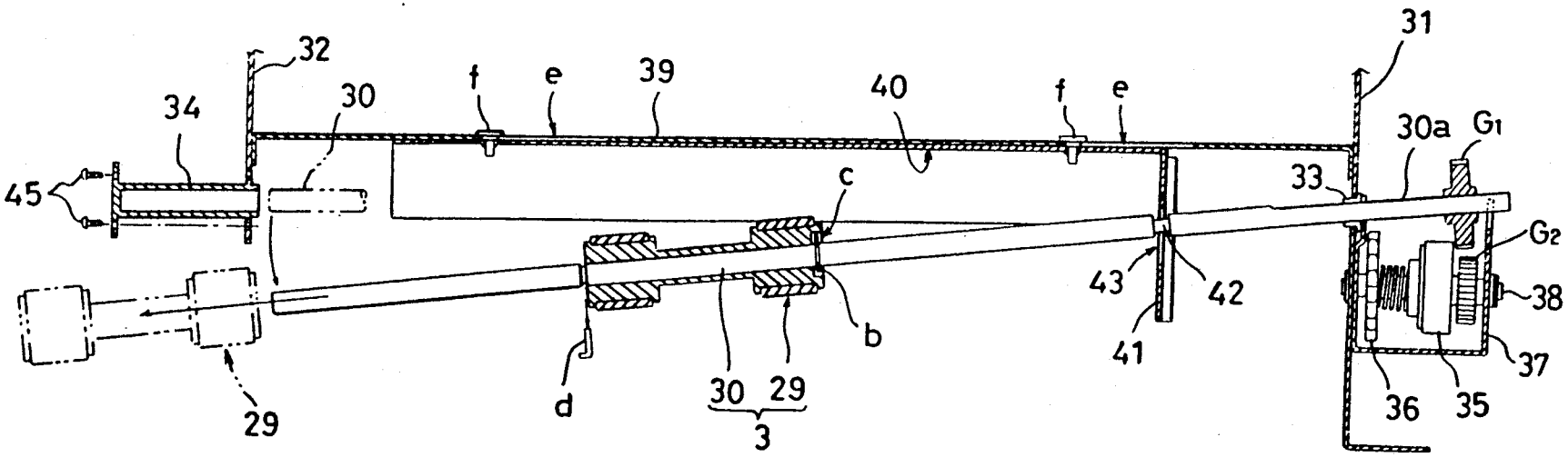
FIG. 8 is a sectional view showing extraction of a paper supplying roller from a paper supplying roller shaft.

The paper supplying roller 3 comprises a body defining a paper supplying roll 29 provided with a roll member made of rubber and having a longitudinal midway portion of reduced or smaller diameter. A roller shaft 30 supports paper supplying roll 29. Roll 29 has at one axial end thereof an engaging concave recess (b) as shown in FIG. 8. On the other hand, roller shaft 30 is provided with a spring pin (c) to be received in recess (b) of the paper supplying roll 29. Stopper means (d) prevents the paper supplying roll 29 from being extracted from shaft 30. Shaft 30 is pivoted on cylindrical bearings 33, 34 provided on a pair of support members 31, 32 on the sides of casing 10 so as to be rotatable and movable in the direction of the axis of rotation of shaft 30.

Figure 2:
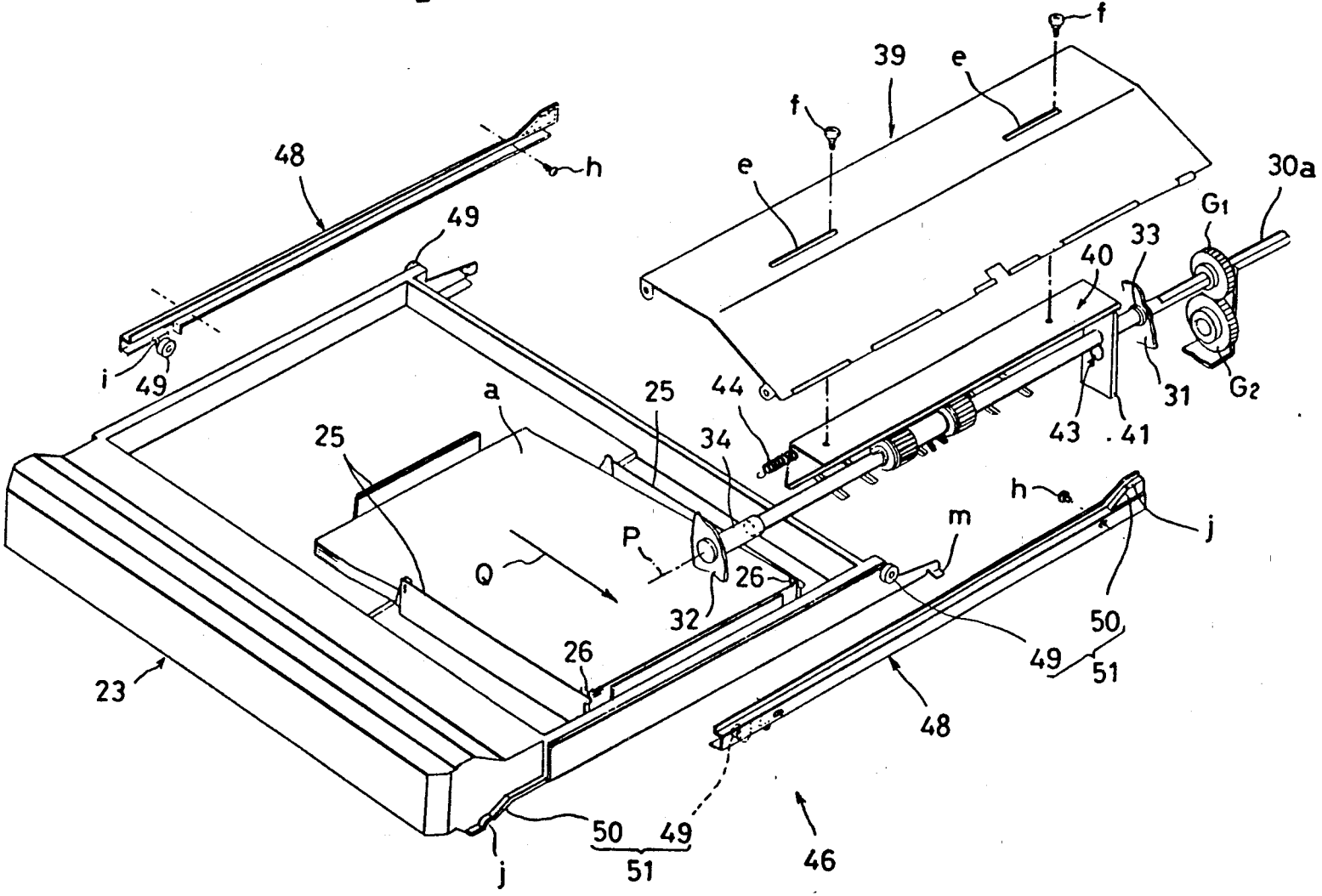
FIG. 2 is an exploded perspective view showing a paper supplying device together with a paper supplying cassette.
Figure 6:
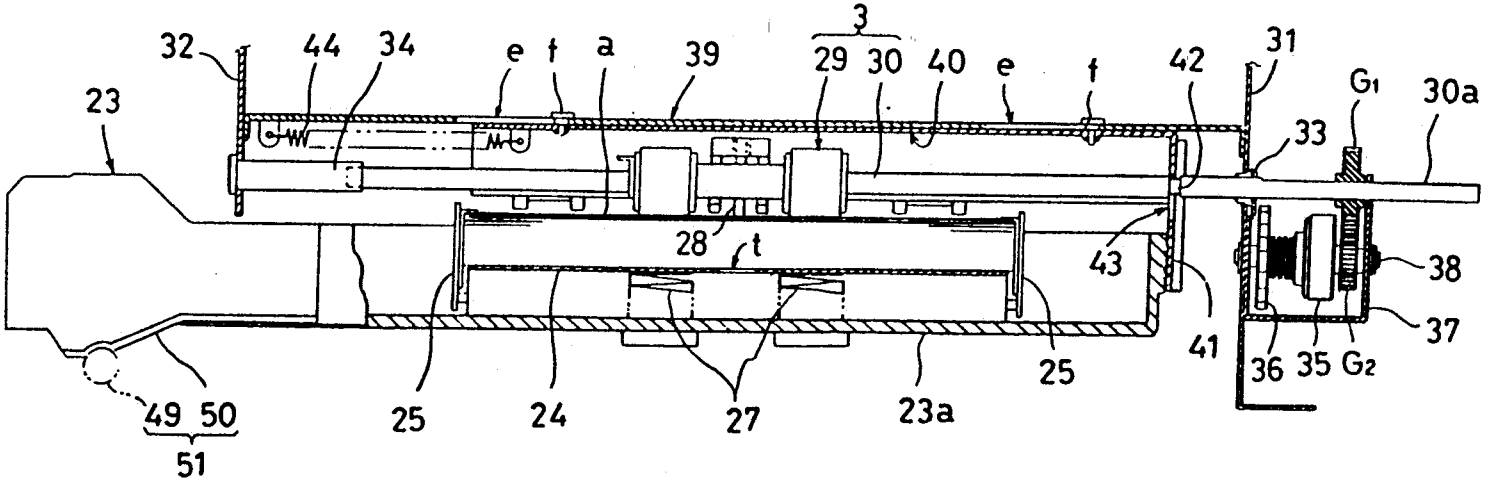
FIG. 6 is a sectional view showing a condition that the paper supplying cassette is charged in a paper supplying portion.

Referring to FIG. 2 and FIG. 6, $G_1$ designates an input gear fitted on an axial end portion 30*a* of the roller shaft 30 projecting from bearing 33. Portion 30*a* has the cross-sectional shape of a letter D so that input gear $G_1$ merely may be slid over portion 30*a*. $G_2$ designates an output gear, and the input gear $G_1$ is engaged with an upper side of said output gear $G_2$. Reference numeral 35 designates a clutch and reference numeral 36 designates an input drive pivoted on a support axis of a bracket 37 connected with support member 31. A part of bracket 37 is adapted to be positioned at one end fact of the input gear $G_1$, and a part of clutch 35 is adapted to be positioned at a location aligned with the other end fact of the input gear $G_1$ under a condition such that upward movement of the axial end portion 30*a* is allowed. That is, even though the roller shaft 30 may be moved reciprocally in the direction of the axis of rotation, the input gear $G_1$ always will be maintained in a position to be driven by a gear.

Figure 7:
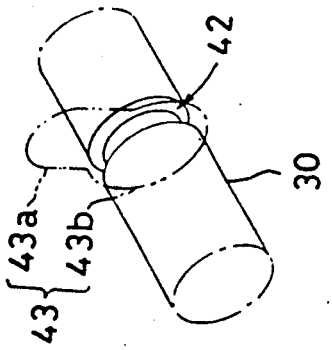
FIG. 7 is a perspective view showing an engaging structure.

Referring to FIGS. 2 to 6, reference numeral 39 designates a plate member provided above the paper supplying roller 3 and mounted on support members 31, 32. Plate member 39 is provided with holes (e) elongated in a direction parallel to the axis of rotation of the paper supplying roller 3. Reference numeral 40 designates a movable member, and screws (f) extending through and movable along holes (e) are threaded into member 40. Movable member 40 is provided with a member 41 to be pressed by paper supplying cassette 23 during insertion thereof. Member 41 is connected to a rear side or end of member 40 in the cassette inserting direction P. Member 41 also may be formed by bending member 40. Member 41 is provided with an engaging-connecting hole 43 for a circular groove 42 formed in the roller shaft 30, as shown in FIG. 7. Engaging-connecting hole 42 has a shape formed by two holes, i.e. one larger hole and one smaller hole, connected to each other. Thus, hole 43 includes an almost semicircular engaging-connecting portion 43*a* having a diameter slightly larger than the diameter of the bottom of circular groove 42 and an expanded width portion 43*b* defining an almost circular space having a diameter larger than the diameter of the roller shaft 30. Thus, the roller shaft 30 may be guided along expanded width portion 43*b*. When groove 42 reaches hole 43, then shaft 30 is lifted and member 41 defining the edge of the engaging-connection portion 43*a* is inserted into groove 40. Thus, the paper supplying roller 3 is integrated with or connected to the movable member 40 through the member 41 such that roller 3 is rotatable relative thereto.

Reference numeral 44 designates position returning means for urging the paper supplying roller 3 in a cassette extracting direction to return the paper supplying roller 3 to an initial position. Such initial position is determined by a position at which screw (f) is caused to engage with an end portion of hole (e) due to position returning means 44.

Figure 3:
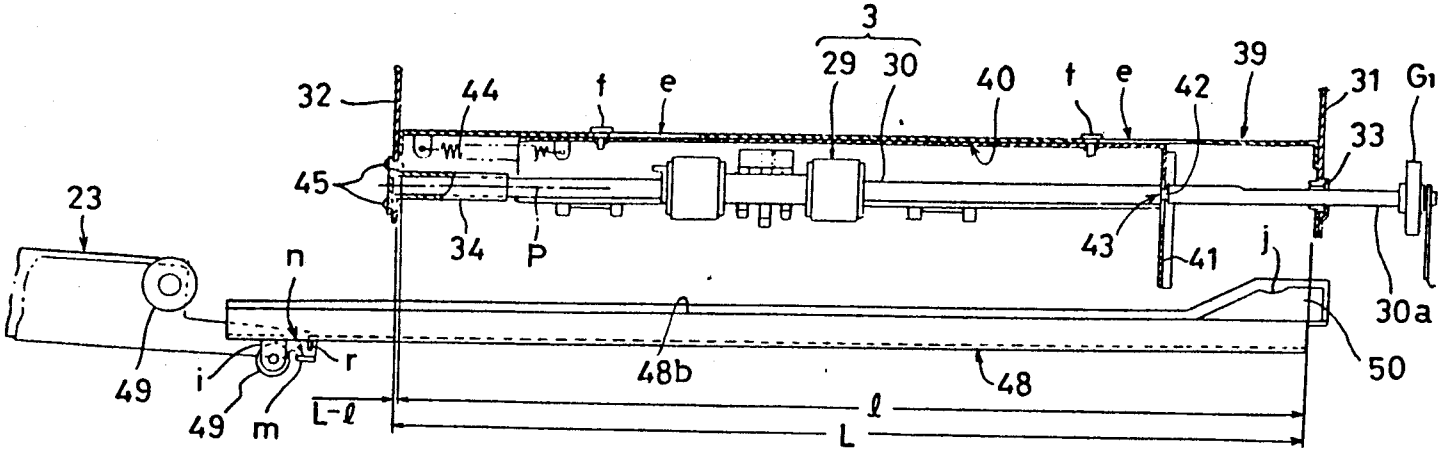
FIGS. 3 and 4 are sectional views showing operation when the paper supplying cassette is inserted.

In the above described construction, a distance l from an inner surface of the support member 31 on one side to an axial end on the other side of the roller shaft 30 is adapted to be slightly smaller than a distance L between inner surfaces of a pair of support members 31, 32. That is, a gap of (L−l) is formed between the respective axial end of the roller shaft 30 and the inner surface of the support member 32 when the roller shaft 30 provided with the paper supplying roll 29 is returned to the initial position by the energizing force of the position returning means 44. At such time, bearing 34 supporting such axial end of the roller shaft 30 is prevented from being extracted from support member 32 by screws 45, as shown in FIG. 3.

According to such the construction, the paper supplying roller 3 is integrated with or connected to the member 41 and thus the movable member 40 so as to be rotatable relative thereto by inserting one end of the roller shaft 30 of the paper supplying roller 3 through the expanded width portion 43*b*, the bearing 33 and the bear $G_1$. Then, the roller shaft 30 is lifted to a horizontal posture, thus engaging and connecting the circular groove 42 of the roller shaft 30 with the engaging-connecting portion 43*a*. The bearing 34 then is inserted on the other end of the roller shaft 30 ans is fastened to member 32 by screws 45 (see FIG. 8).

The paper supporting roll 29 can be extracted from the roller shaft 30 by removing stopper means (d) from the roller shaft 30 and by then following a procedure opposite to the above described procedure.

Figure 5:
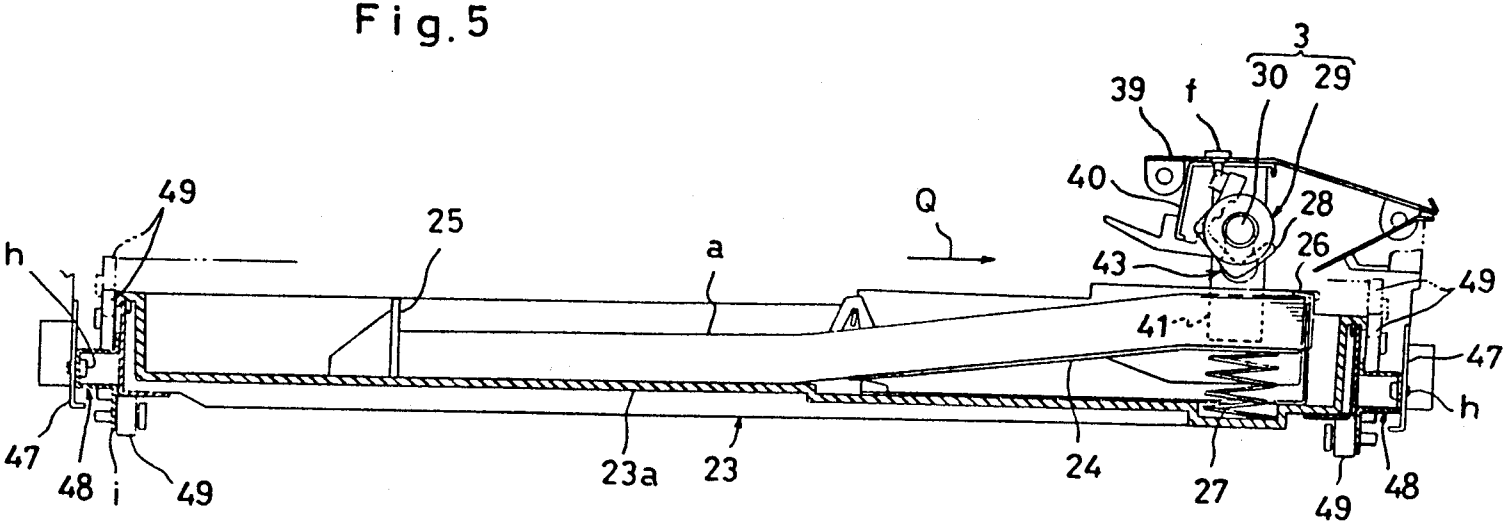
FIG. 5 is a sectional view showing a condition that the paper supplying cassette is being inserted.

Reference numeral 46 is a construction for supporting the paper supplying cassette 23 and having the following structure, as shown in FIG. 5. Thus, the respective paper supplying portions 4 are provided with a pair of bracket member 47 spaced in the paper supplying direction. U-shaped guide members 48 have ribs mounted on bracket member 47 by screws (h). Tongue pieces (i) extend downwardly from upstream portions, in the cassette inserting direction P, of guide members 48 and support rollers 49 rotatable about axes extending in paper supplying direction Q. Other rollers 49 are supported on downstream portions, in the inserting direction P, of opposite sides of paper supplying cassette 23. Cam members 50 are provided at the downstream end, in the cassette-inserting direction P, of the guide members 48 and at upstream ends, in the inserting direction P, of opposite sides of the paper supplying cassette 23.

Rollers 49 and cam members 50 perform the function of moving the paper supplying cassette 23 substantially in an inclined parallel manner shortly before the end of the insertion of the paper supplying cassette 23. Thus, the paper supplying cassette 23 is supported at four points, and each roller 49 and cam member 50 forms a pressing means 51 for lifting the paper supplying cassette 23 in an inclined direction upon charging movement of the paper supplying cassette 23 into the paper supplying portion 4 and for pressing an upper surface of the papers (a) within the cassette against the paper supplying roller 3.

Each pressing means 51 includes a concave recess (j) formed in the respective cam member 50 for receipt of the respective roller 49, such that the paper supplying cassette 23 will not move in the inserting-extracting direction when the paper supplying cassette 23 is charged into the fully inserted position within the paper supplying portion 4.

Figure 4:
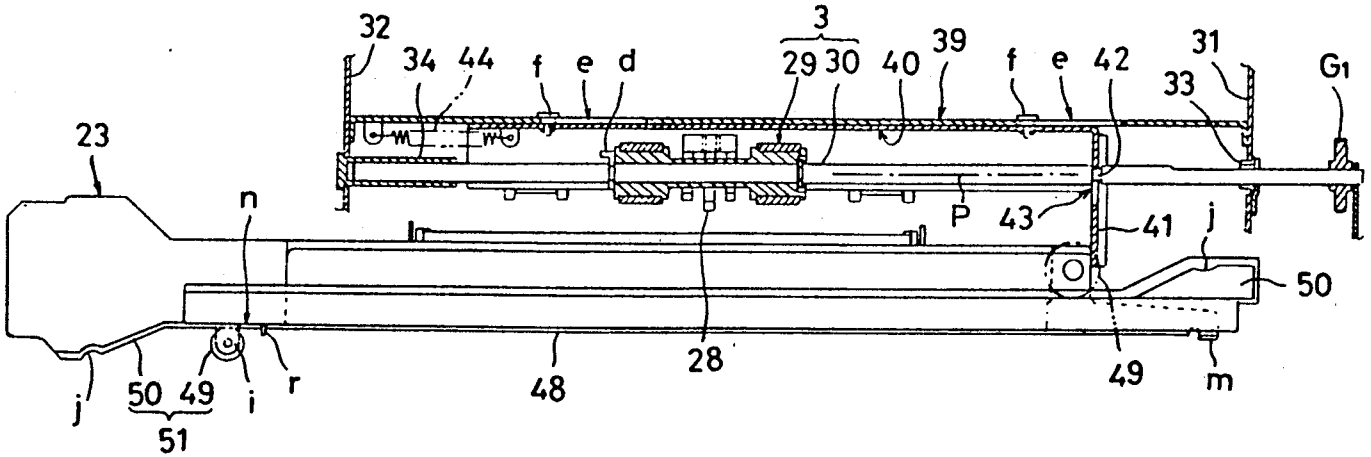

As shown in FIG. 4, a stopper (m) is bent outwardly from opposite sides, at the downstream end in the inserting direction P of the paper supplying cassette 23. A lower plate portion on the upstream side in the cassette inserting direction P of each guide member 48 has extending downwardly therefrom a stopper tongue piece (r) defining an opening (n) through which may be passed the respective stopper (m). When the paper supplying cassette 23 is charged in the paper supplying portion 4, as shown in FIG. 3 the paper supplying cassette 23 is moved in the cassette insertion direction P such that each stopper (m) is passed downwardly through the respective opening (n). The roller 49 of the respective side of paper supplying cassette 23 is positioned on an upper plate portion 48*b* of the respective guide member 48. The downstream end in the inserting direction P of the paper supplying cassette 23 is supported by such roller rolling on the guide member 48. Lower surfaces of opposite sides of the paper supplying cassette 23 are supported by the rollers 49 on respective guide members 48. Thus, the paper supplying cassette 23 is inserted in direction P while being supported at four points.

The guide members are positioned at a height such that, during the time when the cassette is being inserted, the papers (a) within the cassette 23 will not engage with the paper supplying roll 29 of the paper supplying roller 3 or the sensor 28. The cassette 23 is lifted in an inclined manner by an action of the four pressing means 51 shortly before the end of the insertion of the cassette 23. Thus, the sensor 28 engages with the upper surface of the papers (a) and the upper surface of the papers (a) is pressed against roll 29 of roller 3.

The member 41 is positioned to depend downwardly so that the downstream end in the inserting direction P of the paper supplying cassette 23 will engage with member 41 before the sensor 28 is engaged with the upper surface of the papers (a). That is to say, when the cassette 23 is charged into the paper supplying portion 4 along the direction P of the axis of rotation of the paper supplying roller 3, the papers (a) within the cassette 23 move below the paper supplying roll 29 as well as the sensor 28 until the cassette 23 is engaged with the member 41, as shown in FIGS. 4, 5. After the cassette 23 is engaged with the member 41, the roller shaft 30, that is relatively rotatably connected to the member 41, moves in the cassette inserting direction P integrally with the cassette 23. Then, the cassette 23 is lifted in an inclined manner by action of the pressing means 51 to engage the upper surface of the papers (a) within the cassette 23 with the sensor 28 and press it against the paper supplying roll 29. In addition, even though the roller shaft 30 moves, the input gear $G_1$ is not moved and is maintained in engagement with the output gear $G_2$.

When all of the papers (a) within the paper supplying cassette 23 are used, opening (t) no longer is closed by the papers (a), and sensor 28 falls into opening (t), whereby a non-paper alarm lamp and the like (not shown) may be operated.

The paper supplying cassette 23 is extracted from the paper supplying portion 4 by an operation opposite to the cassette charging operation. That is to say, upon extracting the cassette 23, cassette 23 moves downwardly in an inclined manner and simultaneously the paper supplying roller 3 and the movable member 40 are moved to the initial position thereof with the movement of cassette 23 by action of the returning means 44. Thus, the upper surface of the papers (a) is separated from the paper supplying roll 29 and from the sensor 28. When no paper exists in the cassette, the carrying plate 24 is separated from the paper supplying roll 29 and from the sensor 28.

The upstream end of the paper supplying cassette 23 is freely descended and the downstream end thereof, in the inserting direction, tends to lift during a midway portion of an insertion or extraction operation. However, such lifting of the downstream end of the cassette 23 is restricted by the stoppers (m) with respective surfaces of the guide members 48. In addition, the cassette 23 can be prevented from removing from the paper supplying portion 4 by engagement of the stoppers (m) with the stopper tongue pieces (r) of the guide members 48.

Figure 9A:
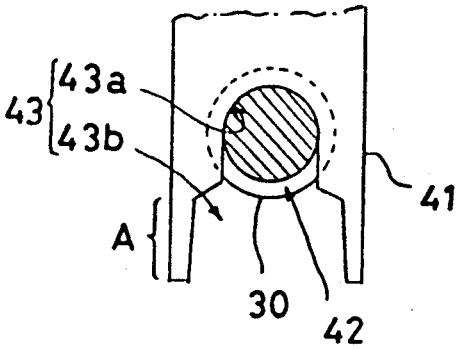
FIGS. 9(A) to 9(C) are partial sectional views showing modifications of the engaging structure.
Figure 9B:
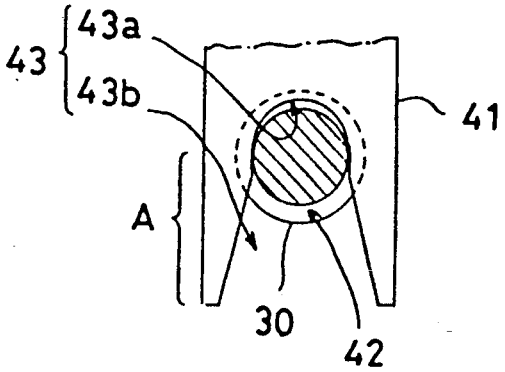
Figure 9C:
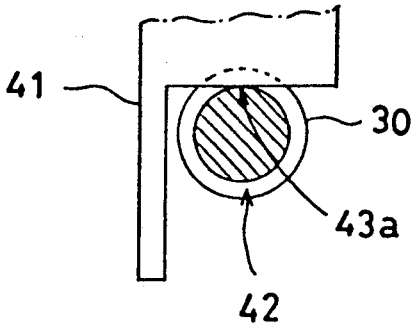

Furthermore, although the member to be pressed 41 has formed therein the hole 43 to engage and connect the portion 43*a* of the hole 43 with the circular groove 42 of the roller shaft 30 in the present preferred embodiment, the following modifications can be adopted. Thus, the member 41 may have formed therein a notch 43 having an expanded width portion 43*b* of a width slightly larger than the diameter of the roller shaft 30 and connected with the engaging-connecting portion 43*a*, as shown in FIG. 9(A). Also, the expanded width portion 43*b* may be expanded downwardly, as shown in FIG. 9(B). Alternatively, a portion of member 41 at A in FIGS. 9(A) and 9(B) may be omitted. Furthermore, the member 41 may be engaged with the upper side of the inner face surface of the circular groove 42, as shown in FIG. 9(C).

Figure 10:
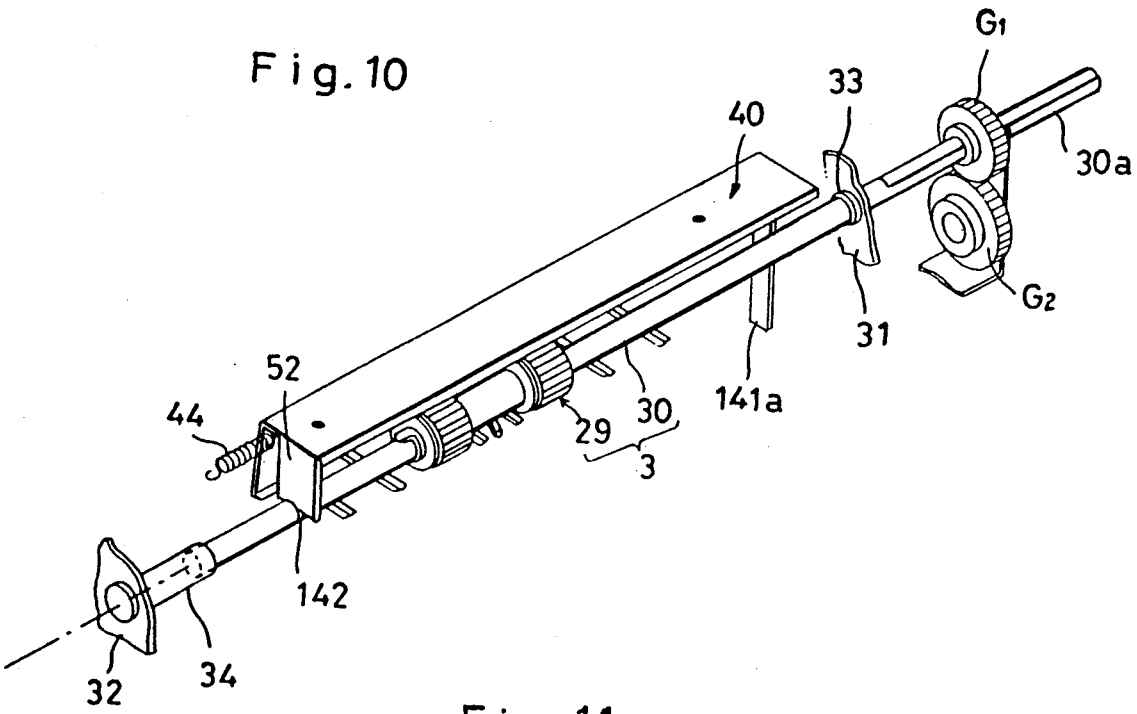
FIG. 10 is an exploded perspective view showing a paper supplying device according to another preferred embodiment.

Next, another preferred embodiment of means for relatively rotatably integrating the paper supplying roller 3 with the movable member 40 will be below described with reference to FIG. 10. In this preferred embodiment, plate members 141*a*, 52 are bent downwardly from or connected with opposite downstream and upstream ends, in the cassette inserting direction P, of movable member 40. Plate member 141*a* is a member to receive a pressing force from a paper supplying cassette 23. A lower end portion of plate member 52 defines an engaging-connecting portion 143*a* that is received in and engages with an upper side of an inner end face of a circular groove 142 formed in a roller shaft 130 of paper supplying roller 3. Otherwise, elements similar to those in FIG. 2 are denoted by the same reference numerals as in FIG. 2 and duplicate description thereof is omitted herein.

Figure 11:
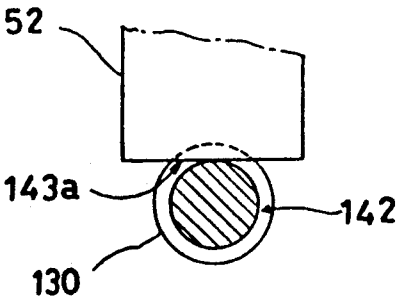
FIG. 11 is a partial sectional view showing an engaging structure.

According to this construction, the engaging-connecting portion 143*a* is merely engaged with the upper side of the inner end face of circular groove 142, as shown in FIG. 11, so that the circular groove 142 can be engaged with and disengaged from the engaging-connecting portion 143*a* merely by slightly ascending and descending roller shaft 130. Accordingly, the paper supplying roller 3 can be positioned relative to both bearings 33, 34 within a narrow dimensional range.

Figure 12B:
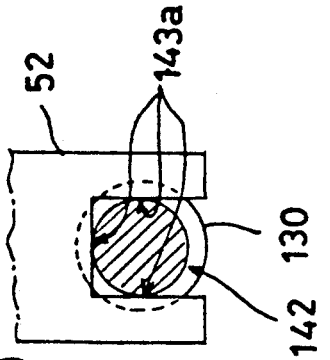
FIGS. 12(A) and 12(B) are partial sectional views showing modifications of the engaging structure shown in FIG. 11.
Figure 12A:
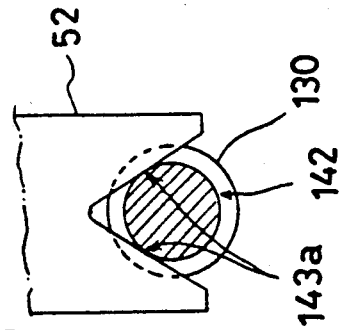
Figure 13:
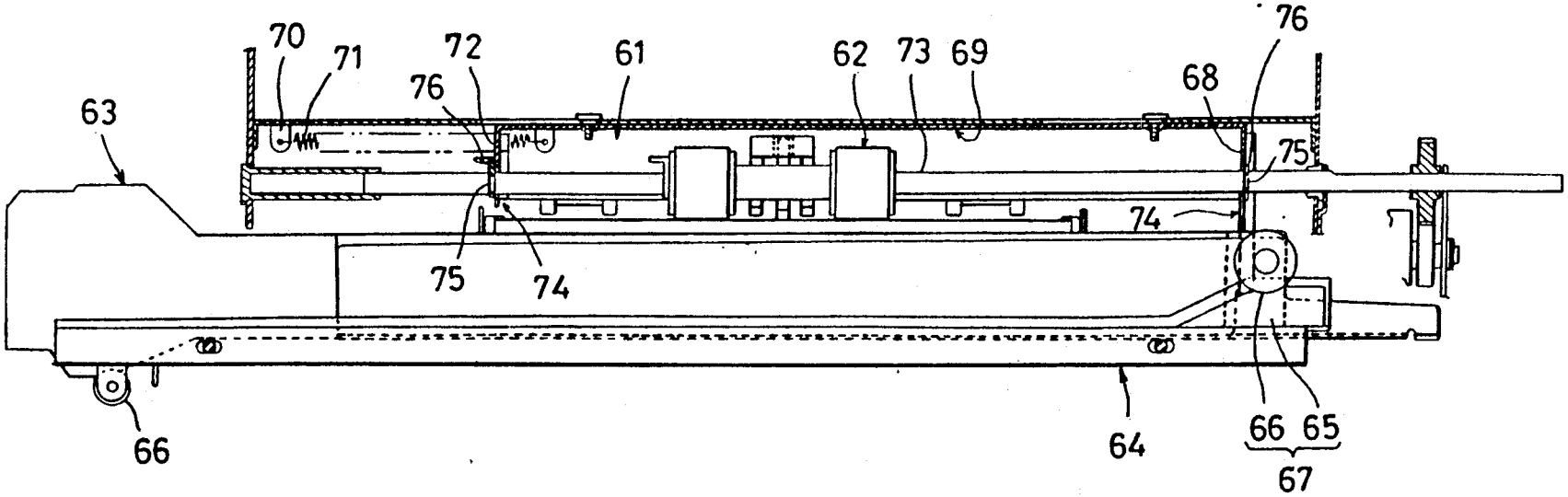
FIG. 13 is a sectional view showing principle parts of a previous paper supplying roller shaft.

In addition, a lower side of the plate member 52 may be cut or formed by have the shaft of an inverted letter V, and opposite surfaces thereof may be used as the engaging-connecting portion 143*a* to engage spaced positions of thinner end face of the circular groove 142, as shown in FIG. 12(A). Also, the lower end of the plate member 25 may be cut or formed therein a rectangular recess having opposite side edges and an upper edge that may be used as the engaging-connecting portion 143*a* to engage with upper and opposite side portions of the inner end face of the circular groove 142, as shown in FIG. 12(B). Such engaging-connecting construction can be used in place of that shown in FIG. 7 and FIGS. 9(A) to 9(C), or on the contrary the engaging-connecting construction shown in FIG. 7 and FIGS. 9(A) to 9(C) can be used in place of that shown in FIGS. 11–12(B).

As above described, the paper supplying device wherein a paper supplying cassette is inserted and extracted in the direction of an axis of rotation of a paper supplying roller according to the present invention is characterized in that the paper supplying cassette is moved together with the paper supplying roller. That is, a roller shaft of the paper supplying roller is relatively rotatably integrated with a movable member with which is connected a member to be pressed by the cassette is connected. This prevents the papers from being damaged or shifted sideways. An engaging-connecting portion connected to the roller shaft is formed in the member to be pressed itself or in a plate member connected with the movable member. A circular groove to be engaged and connected with the engaging-connection portion is formed at one position of the roller shaft.

According to such construction, manufacture and assembly of the roller shaft can be simplified, and thus costs can be reduced compared with conventional constructions.

What is claimed is:

1. In a paper supplying device in an image forming apparatus, wherein a paper supplying cassette is adapted to be inserted into and extracted from a paper supplying portion in a direction of an axis of rotation of a paper supplying roller, said paper supplying roller being movable in said direction of said axis of rotation thereof, pressing means for pressing an upper surface of papers within said paper supplying cassette against said paper supplying roller upon movement of said paper supplying cassette in said direction into said paper supplying portion, a first member to receive a pressing force from said paper supplying cassette before the upper surface of the papers is pressed against said paper supplying roller and mounted on a second member movable in the direction of movement of said paper supplying roller, said paper supplying roller being connectable to said movable second member so as to be only rotatable relative thereto, and returning means for returning said first member to an initial position thereof, the improvement wherein:

a circular groove is formed at one position of a roller shaft of said paper supplying roller; and said first member has an engaging-connecting portion disengageably engaging in said circular groove.

2. The improvement claimed in claim 1, wherein said engaging-connection portion has formed at a lower end thereof an expanded width portion of a size larger than said roller shaft, such that said expanded width portion of said engaging-connecting portion may be guided into said circular groove by lifting said roller shaft.

3. The improvement claimed in claim 2, wherein said engaging-connecting portion is formed so as to be engaged with almost half of an inner end face defining said circular groove.

4. The improvement claimed in claim 2, wherein said engaging-connecting portion is formed so as to be engaged with opposite sides of an inner end face defining said circular groove.

5. The improvement claimed in claim 1, wherein said engaging-connecting portion is formed so as to be engaged with almost half of an inner end face defining said circular groove.

6. The improvement claimed in claim 1, wherein said engaging-connecting portion is formed so as to be engaged with an upper side of an inner end face defining said circular groove.

7. The improvement claimed in claim 1, wherein said engaging-connecting portion is formed so as to be engaged with opposite sides of an inner end face defining said circular groove.

8. The improvement claimed in claim 7, wherein said engaging-connecting portion is formed so as to be engaged with an upper portion and said opposite sides of said inner end face defining said circular groove.

9. In a paper supplying device in an image forming apparatus, wherein a paper supplying cassette is adapted to be inserted into and extracted from a paper supplying portion in a direction of an axis of rotation of a paper supplying roller, said paper supplying roller being movable in said direction of said axis of rotation thereof, pressing means for pressing an upper surface of papers within said paper supplying cassette against said paper supplying roller upon movement of said paper supplying cassette in said direction into said paper supplying portion, a first member to receive a pressing force from said paper supplying cassette before the upper surface of the papers is pressed against said paper supplying roller and mounted on a second member movable in the direction of movement of said paper supplying roller, said paper supplying roller being connectable to said movable second member so as to be only rotatable relative thereto, and returning means for returning said first member to an initial position thereof, the improvement wherein:

a circular groove is formed at one position of a roller shaft of said paper supplying roller; and a plate member connected with said movable second member has an engaging connecting portion disengageably engaging in said circular groove.

10. The improvement claimed in claim 9, wherein said plate member extends downwardly from a downstream end in said cassette inserting direction of said movable second member, and said engaging-connecting portion is formed in said plate member.

11. The improvement claimed in claim 10, wherein said engaging-connecting portion has formed at a lower end thereof an expanded width portion of a size larger than said roller such that said expanded width portion of said engaging-connecting portion may be guided into said circular groove by lifting said roller shaft.

12. The improvement claimed in claim 10, wherein said engaging-connecting portion is formed so as to be engaged with almost half of an inner end face defining said circular groove.

13. The improvement claimed in claim 10, wherein said engaging-connecting portion is formed so as to be engaged with an upper side of an inner end face defining said circular groove.

14. The improvement claimed in claim 10, wherein said engaging-connecting portion is formed so as to be engaged with opposite sides of an inner end face defining said circular groove.

15. The improvement claimed in claim 14, wherein said engaging-connecting portion is formed so as to be engaged with an upper portion and said opposite sides of said inner end face defining said circular groove.

* * * * *